United States Patent [19]

Parmer

[11] 4,262,293

[45] Apr. 14, 1981

[54] DEPLOYABLE LOG PERIODIC VEE ANTENNA

[75] Inventor: Jerome F. Parmer, San Diego, Calif.

[73] Assignee: Gernal Dynamics (Convair), San Diego, Calif.

[21] Appl. No.: 950,463

[22] Filed: Oct. 11, 1978

[51] Int. Cl.[2] ..... H01Q 11/10; H01Q 1/08

[52] U.S. Cl. ..... 343/792.5; 343/881

[58] Field of Search ..... 343/792.5, 880, 881, 343/882, 705, 706, 707, 708

[56] References Cited

U.S. PATENT DOCUMENTS

| | | | |
|---|---|---|---|
| 2,964,748 | 12/1960 | Radford | 343/792.5 |
| 3,518,690 | 6/1970 | Schick et al. | 343/792.5 |
| 4,115,783 | 9/1978 | Reggia | 343/895 |

FOREIGN PATENT DOCUMENTS

| | | | |
|---|---|---|---|
| 495019 | 11/1938 | United Kingdom | 343/706 |

*Primary Examiner*—Eli Lieberman

*Attorney, Agent, or Firm*—John R. Duncan; Frank D. Gilliam

[57] ABSTRACT

A log periodic VEE antenna particularly useful for space craft including a central mast and dipole antenna elements which are collapsible into a compact configuration for transportation purposes and which are deployable in spring-like fashion when released from their confinement. In one embodiment, the antenna elements themselves are semi-circular elements and confined in a bent position in a suitable container for transportation and which, when removed from the container, spring into deployed position. In another embodiment, the dipole elements are flexible wire with a spine member having a semi-circular spring member bent when the antenna is collapsed and which, when released from its confinement deploys the wire elements. The semi-circular elements besides having a deployment function also give rigidity to the antenna when deployed.

3 Claims, 9 Drawing Figures

2
2
10
14
18
20
14
20
16
14
12
20
14
20

24
26
16
18
12
26
24
26
24
16
18
18
26
18
24

10

16
22

26
16
24
18
22

50
60

52
54
44
40
42
46
56
56
44
56
56
56
60
60
62
58
50
50
58
60
50
58
64
48

DEPLOYABLE LOG PERIODIC VEE ANTENNA

BACKGROUND OF THE INVENTION

This invention relates to antennas and more particularly to an improved deployable log periodic VEE antenna especially adaptable for space craft where compactness, reliability and resistance to thermal distortion is important.

Deployable antennas are well known in the art. Typical examples thereof are shown in the U.S. patents to Mirrione et al. U.S. Pat. No. 3,950,758, to Carr U.S. Pat. No. 3,213,415, to Barbano, et al. U.S. Pat. No. 3,500,424, and to Esposito, et al. U.S. Pat. No. 3,715,759.

The Mirrione et al. antenna uses self locking hinges intermediate the ends the mast and the antenna elements for folding of the antenna primarily for the purpose of convenient boxing. This antenna is heavy being directed to the home and commercial market.

The Carr antenna has its antenna elements connected at the ends by pins for collapsing and expanding the antenna in a zigzag fashion. This antenna is utilizable in commercial television, and like the Mirrione et al. antenna, is generally unsuitable for space craft.

The Barbano et al. antenna is formed of a flexible sheet to permit folding for storage and the Eposito et al. antenna is similar but uses an inflatable spherical enclosure to unfurl the antenna elements.

Also, there are numerous patents teaching log periodic principles in a design of antennas, one such patent for example, is the U.S. patent to Cory et al. U.S. Pat. No. 3,697,999. However, none of the foregoing have the concept of utilizing low expansion material in a log periodic antenna whereby dimensional stability is obtained over a large temperature range so as to be useful in space craft, nor do they show an antenna capable of being easily collapsed into a small configuration for transportation purposes and yet reliably deployed when desired, by a means which also gives rigidity to the deployed antenna.

Accordingly, it is a primary object of this invention to provide a log periodic antenna configuration utilizing low expansion material so that dimensional stability is obtained over a large temperature range so as to be particularly useful in space craft and which can be collapsed into a small compact configuration and reliably deployed.

SUMMARY AND ADDITIONAL OBJECT OF THIS INVENTION

The antenna which accomplishes the foregoing object comprises a central mast having a plurality of antenna elements connected thereto and constructed of a light weight low expansion material. The antenna elements themselves, in one embodiment, are made of semi-cylindrical light weight easily bendable material so as to be collapsed into a relatively small compact configuration and containable in a shell which acts as a confinement means. Upon removal from the shell, the antenna elements are suitably deployed into a log periodic VEE antenna configuration by the bendable material returning to its original state in a spring-like fashion. The shell serves to position and confine the antenna elements in their collapsed bent position and the semi-cylindrical bendable material gives an overall stiffness to antenna structure upon deployment. In another embodiment of the invention, the semi-cylindrical material is formed to act as a hinge which is easily bent and provides a spring action by returning to its original state for deployment of the antenna elements upon release of the confinement means.

Thus, still another object of this invention is to provide a log periodic VEE antenna utilizing semi-cylindrical material in spring-like fashion to enable confinement of the antenna and to deploy the antenna elements upon release from a confining means.

Additional objects of this invention will become apparent to those skilled in the art from the following description and drawings.

BRIEF DESCRIPTION OF THE PREFERRED EMBODIMENTS

Turning first to FIGS. 1 through 6 which discloses the first embodiment of the invention, it can be seen that there is provided an antenna, indicated in its entirety as 10, comprising a central mast 12 and a plurality of antenna elements 14. The antenna in the embodiment disclosed is a log periodic VEE type antenna and, typically the dipole elements are longest at the lower end of the antenna gradually decreasing in length to a short element near the top. The length of the elements and their spacing from one another is according to conventional criteria for forming a log periodic antenna. As such, the length and spacing of the elements do not form a part of this invention and need not be discussed further herein except to point out that they are alternately spaced on the central mast and thus do not interfere with one another in their collapsed position.

Figure 2:
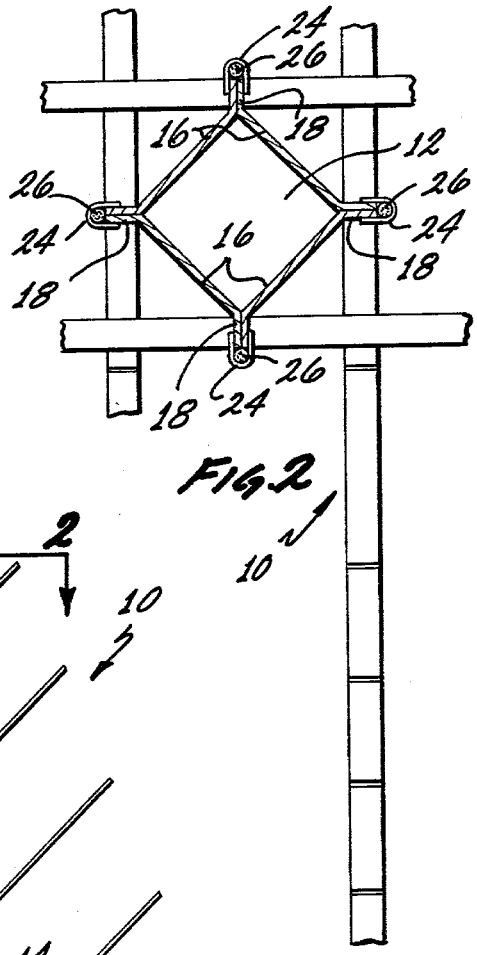
FIG. 2 is a cross-sectional view taken along line 2—2 of FIG. 1 and looking into the direction of the arrows to show the center support mast and a portion of the deployed antenna elements.

The mast 12 is a slightly tapered cone with the narrowest portion at the top and is formed of four relatively thin flat sidewalls 16 each having a pair of outwardly extending flanges disposed in abutting relationship to form the mast of generally rectangular configuration, the cross section of which is shown in FIG. 2.

The flanges 18 are connected together in a suitable manner, as by brazing or soldering, and give rigidity to the mast.

Figure 3:
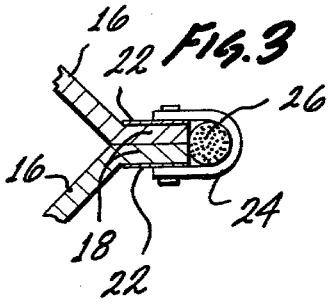
FIG. 3 is an enlarged fragmentary cross-sectional view of a portion of the mast to show the coaxial feed for the antenna elements.
Figure 4:
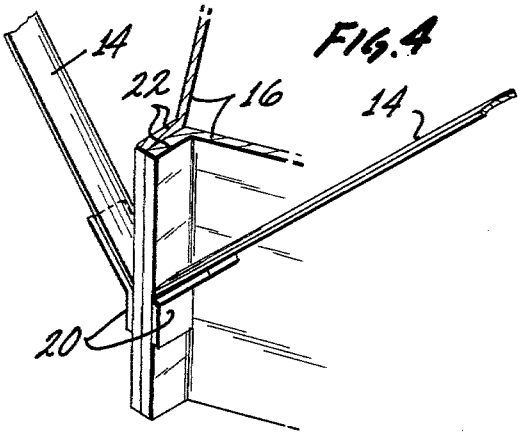
FIG. 4 is a perspective view, partially broken away, to show the means for attaching the antenna elements to the mast.

As shown in FIG. 4, the antenna elements are semi-cylindrical and are connected on each side of the flanges 18 by a flexible conductive hinge 20 one leg of which is fixed to the flanges and the other positioned in the direction coextensive with the desired angle of the deployed dipole elements. Further, as shown in FIG. 3, suitable transmission lines 22 are plated or bonded to the flanges 18 and a plurality of U-shaped straps 24 are riveted to the flanges at several places throughout their length to secure a suitable transmission line in the form of a coaxial cable 26 located coextensively with the center line of each of the joints between the flanges.

With the antenna elements themselves being formed of semi-cylindrical material, which material is determined by two requirements; the material must be suitable for the electrical antenna properties and must be sufficiently rigid yet flexible enough to bend in spring-like fashion. Thus, formed they are capable of being bent upwardly, that is, toward the small end of the tapered central mast 12 to form the collapsed position of the antenna for confinement in a shell-like container 28.

Figure 1:
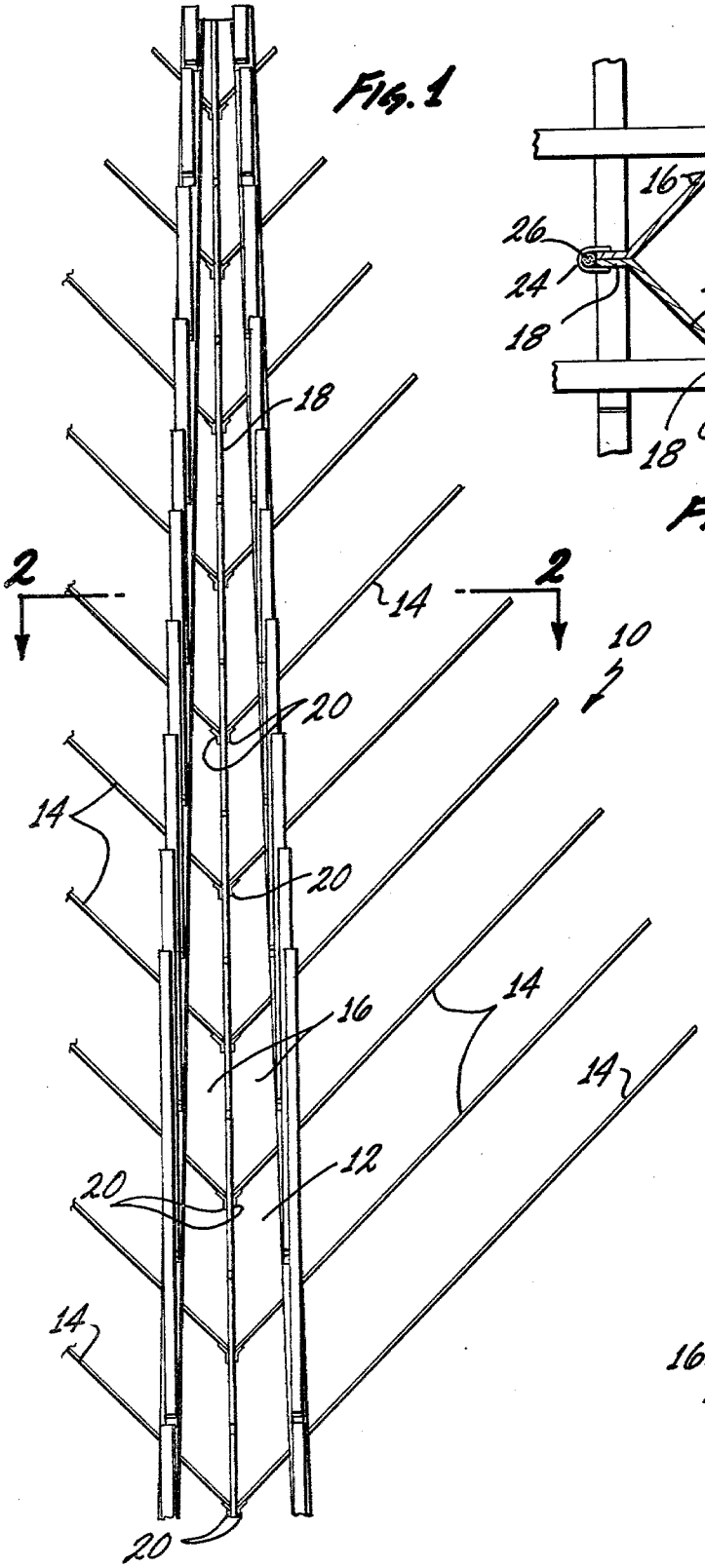
FIG. 1 shows one embodiment of the antenna constructed in accordance with the teachings of this invention with some of the antenna elements shown deployed.
Figure 5:
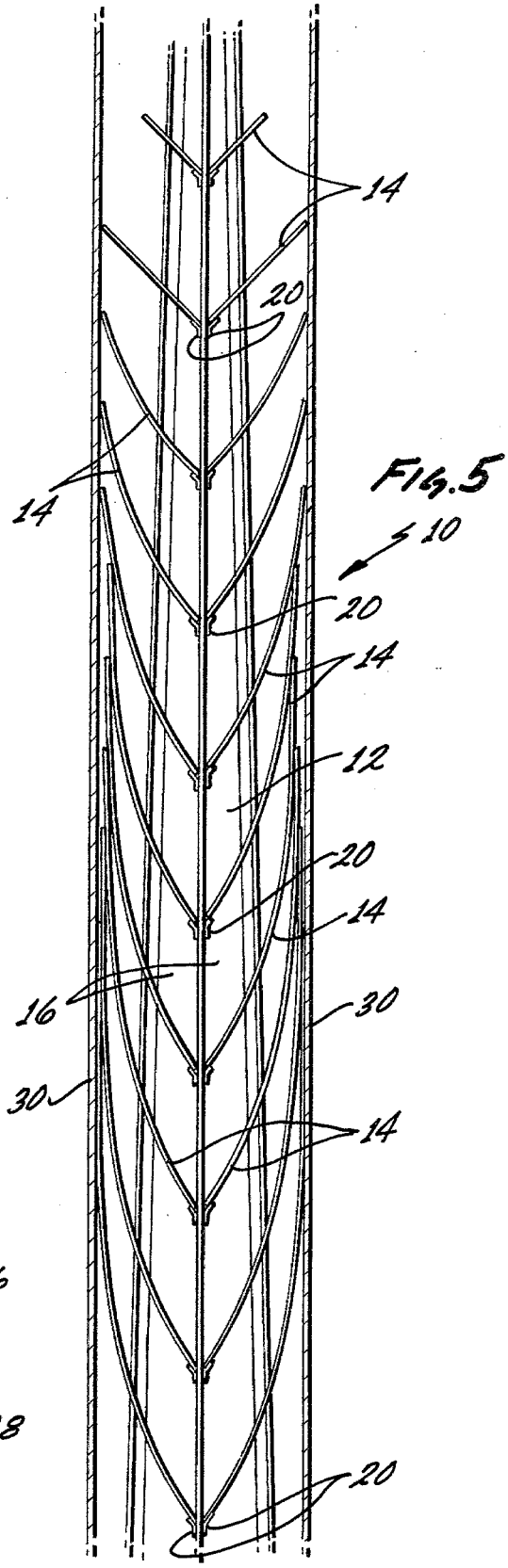
FIG. 5 is a elevational cross-sectional view of the antenna encased in a container shell.
Figure 6:
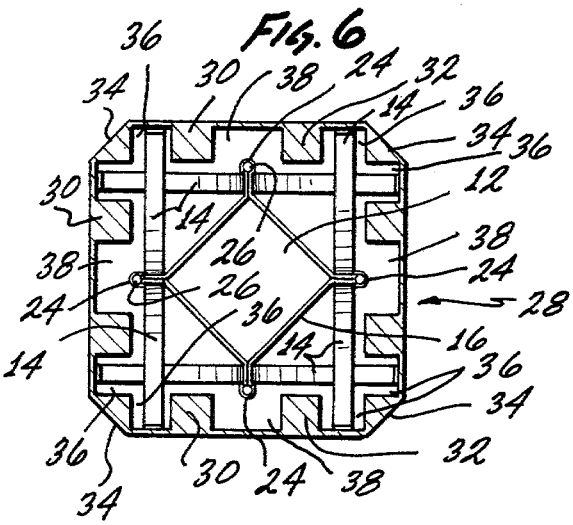
FIG. 6 is a cross-sectional view of the antenna and mast to show the container shell in more detail than shown in FIG. 5.

In the collapsed position, the antenna may be confined within the container 28 which is shown more particularly in FIGS. 5 and 6. The container is formed of relatively thin sidewalls 30, slightly longer than the mast and antenna in its collapsed position. The sidewalls 30, being relatively thin, are reinforced with spaced apart reinforcing members 32 shown as rectangular in cross-section, except for those reinforcing members 34 forming the corners of the container and are spaced apart a distance sufficient to allow the antenna elements to be positioned therebetween in their proper alternating relationship within the container. The spaces for the antenna elements are indicated at 36, and the spaces to accommodate the cables 26 and clamps 24 are shown at 38. In this container shell, the antenna may be confined in its collapsed position for transportation purposes and at the appropriate time the four sidewalls of the shell, being held together by any suitable means such as wire straps (not shown) are separated and the confined antenna members will then spring apart ie., be deployed to form the antenna by virtue of the operation of the bent semi-cylindrical material. This position is shown in FIGS. 1 and partially in 2.

Thus described in the first embodiment is log periodic VEE antenna which is first confined in a container then deployed, when removed from the container, by the spring-like action of the antenna element. The material used in forming the mast 12 and the antenna elements as well as the sidewalls of the container shell is resistant to thermal distortion being a low expansion material such as PRD49 Kevlar. Too, when the antenna elements, being semi-cylindrical, are rigid when deployed adding to the overall stiffness of the antenna structure.

From the foregoing description of the first embodiment it can be seen that the principle of utilizing semi-cylindrical bendable means which is forced into a bent position has a tendency to return to its original state to collapse and deploy an antenna. This concept is incorporated in the antenna elements themselves so that the spring-like action of this semi-cylindrical means is utilized in the deployment of the antenna elements. This principle is carried forward in another embodiment of the invention which will now be described.

Figure 7:
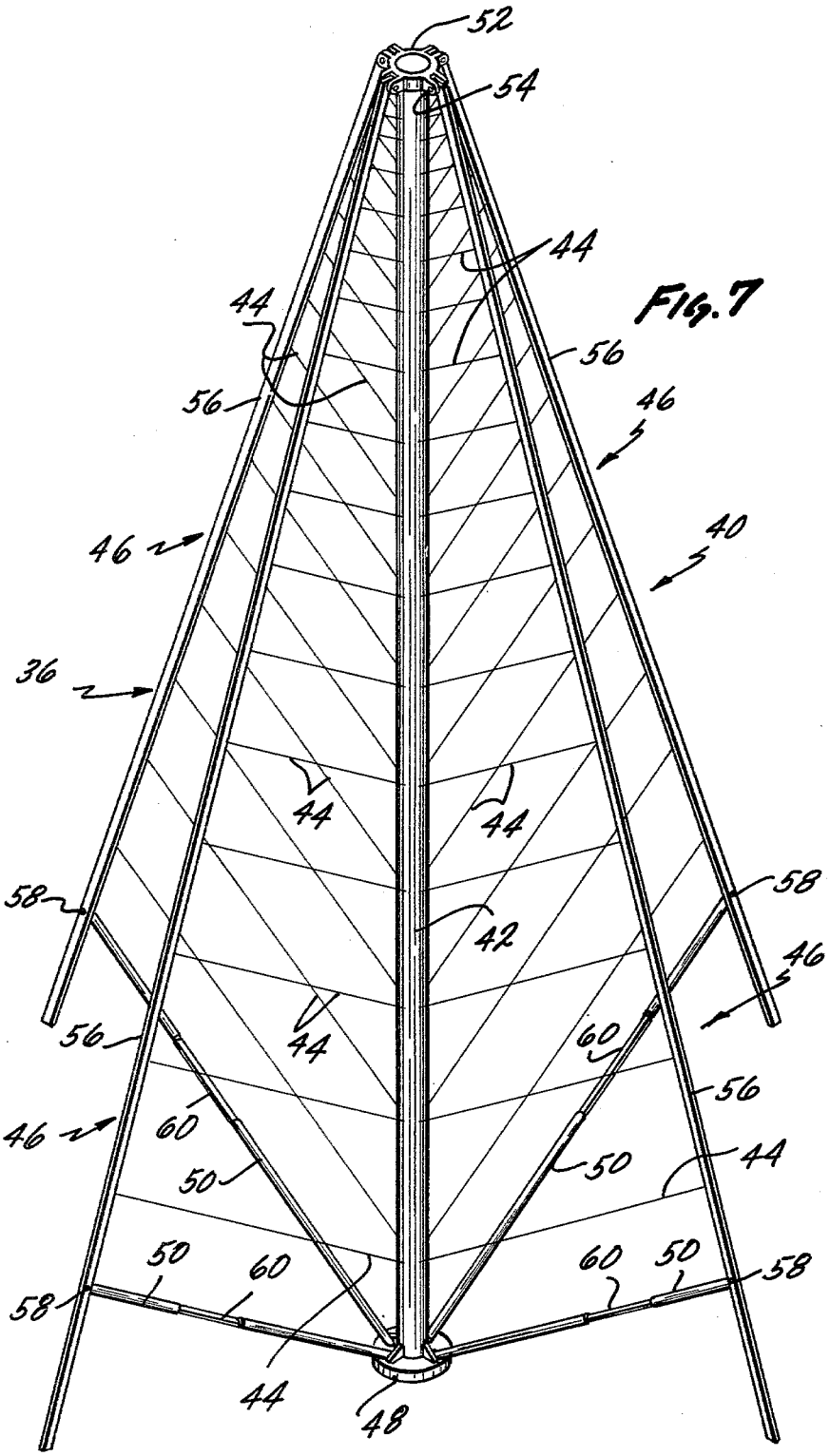
FIG. 7 is another embodiment of the antenna shown in a deployed condition.
Figure 8:
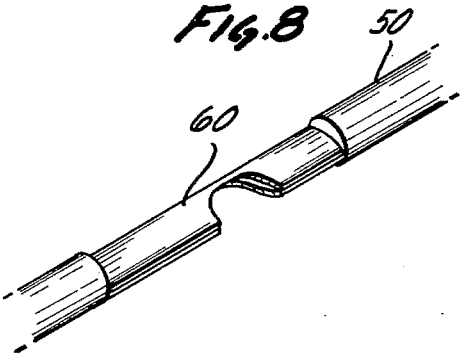
FIG. 8 is an enlarged view, partly in section to show the semi-cylinder deployment springs of the antenna of the embodiment of FIG. 7.
Figure 9:
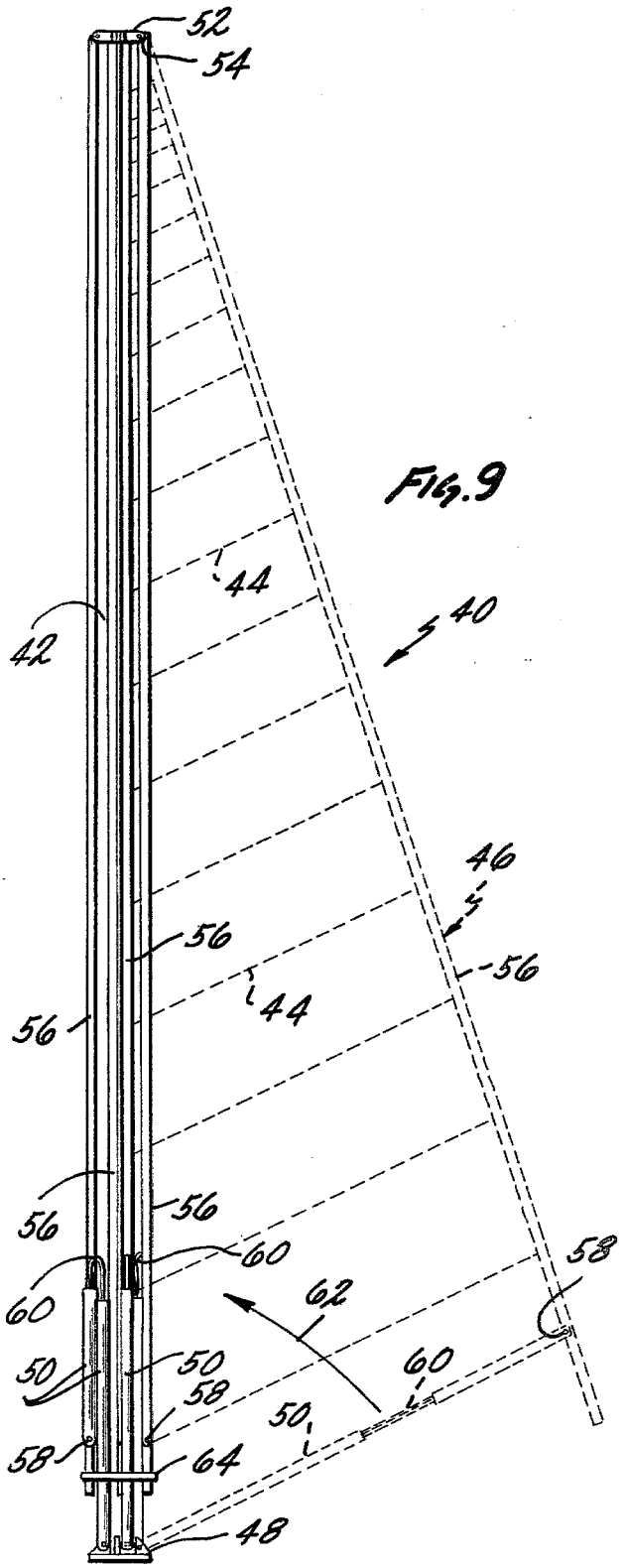
FIG. 9 is a elevational view of the antenna of FIG. 7 shown with the antenna elements in a collapsed position and with some of the antenna elements shown in phantom to show their deployed position.

Turning now to FIGS. 7, 8, and 9, the antenna 40 of this embodiment comprises a long central hollow rod forming a mast 42 with a plurality of wire antenna elements 44 radiating therefrom and configured into trusses 46 (four shown), to form a cone shaped antenna when deployed. This mast is formed with a flange 48 on the bottom serving to support the antenna and to which is hinged a plurality of spines 50 which, in the deployed position, extend outwardly in the general direction of the antenna elements and form the first elements of the trusses 46. The mast is also provided with a top flange 52 to which is also hinged as at 54 a second set of spines 56 which form the second elements of the trusses 46. Each spine of this second set is hingedly connected at 58 to the first mentioned spines 50, at their ends apart from the mast, and thus form deployable trusses for the wire antenna elements 44. These spines are rigid and shown as hollow rods, circular in cross-section, to adequately support the antenna elements in a deployed position.

Each of the first spines 50 is provided substantially midway with a short section of semi-circular material which forms the flexible means 60 ie, in this embodiment a hinge, and shown in FIG. 8, partially in section for clarity, which may be bent so as to collapse the antenna as shown in FIG. 9. In this embodiment, the antenna elements are of a length which determined by the criteria for log periodic antennas, and as such are attached at their inner end to the mast 42 and at their outer end to the spines 56. Being of wire they do not interfere with the collapsing of the trusses 46 in collapsed position.

To collapse the antenna, the flexible hinge means 60 is bent so that the outer spines 56 move inwardly towards the center mast about their top hinge means 60 into two legs which fold back on one another generally in the direction of the arrow 62 as shown in FIG. 9. In this position a clamp 64 of any suitable type is placed around the mast and spines holding them parallel to the central mast. The antenna in this position is readily transportable. However, when deployment is desired, the clamp 62 is removed and the spring-like action of the semi-circular hinge means 60 with its tendency to return to its original position, straightens the lower spines 50 causing the outer spines 56 to assume a cone position thus deploying the antenna elements.

In this embodiment like the previous embodiment the center mast is provided with suitable cables and transmission lines for the antenna elements.

What is claimed is:

1. A collapsible self deploying antenna comprising:

a four sided truncated central mast, the corners of said mast having outward laterally extending flanges and a plurality of semi-cylindrical antenna elements attached to each side of each of said flanges and extending outwardly therefrom in a normally biased deployed position, said elements being bendable against their semi-cylindrical contour to allow said elements to assume a collapsed position generally adjacent said flanges and operable in a spring like manner to return from said collapsed position to said deployed position.

2. The antenna as claimed in claim 1 further including confinement means for securing said antenna elements in their collapsed position and which confinement means, when removed from said antenna will allow said bendable means to deploy said antenna elements.

3. The antenna as claimed in claim 2 wherein said confinement means comprises a container shell for containing and confining the antenna elements in their collapsed position, said container shell having removeable sidewalls which release said bendable means to deploy said antenna elements.

* * * * *